US011993943B2

(12) United States Patent
Lackey

(10) Patent No.: US 11,993,943 B2
(45) Date of Patent: May 28, 2024

(54) SUPPORT SYSTEM FOR USE IN CONSTRUCTION

(71) Applicant: Southern Coastal Contractors & Services, Inc., Hitchcock, TX (US)

(72) Inventor: Martin Nathaniel Lackey, Brenham, TX (US)

(73) Assignee: Southern Coastal Contractors & Services, Inc., Hitchcock, TX (US)

( * ) Notice: Subject to any disclaimer, the term of this patent is extended or adjusted under 35 U.S.C. 154(b) by 1143 days.

(21) Appl. No.: 16/784,324

(22) Filed: Feb. 7, 2020

(65) Prior Publication Data

US 2021/0246650 A1 Aug. 12, 2021

(51) Int. Cl.

| | |
|---|---|
| ***E04G 7/02*** | (2006.01) |
| ***E04G 1/18*** | (2006.01) |
| ***E04G 3/28*** | (2006.01) |
| *E04G 1/24* | (2006.01) |
| *E04G 1/28* | (2006.01) |

(52) U.S. Cl.

CPC ..... *E04G 7/02* (2013.01); *E04G 1/18* (2013.01); *E04G 3/28* (2013.01); *E04G 2001/242* (2013.01); *E04G 1/28* (2013.01)

(58) Field of Classification Search

CPC ..... E04G 1/18; E04G 1/28; E04G 2001/242; E04G 7/02

See application file for complete search history.

(56) References Cited

U.S. PATENT DOCUMENTS 1,473,817 A 11/1919 Gorsline
2,062,473 A * 12/1936 Norton ..... E04G 1/34 182/208
2,237,572 A * 4/1941 Manion ..... E04G 7/02 182/178.3
2,658,776 A 3/1950 Wilcox
4,143,991 A 3/1979 Stafford
(Continued)

FOREIGN PATENT DOCUMENTS

CN 109610819 A 4/2019
GB 1344258 1/1974
(Continued)

OTHER PUBLICATIONS

Heavy Duty Safety Shorting System, retreived Feb. 14, 2020 from https://secureservercdn.net/198.71.233.109/e2c.24b.myftpupload.com/wp-content/uploads/DT-SP-Sell-Sheet_low-res-1.pdf, DirecTank Environmental Products, Houston, 2 pages, Texas USA.

*Primary Examiner* — Colleen M Chavchavadze

(74) *Attorney, Agent, or Firm* — Crain, Caton & James, P.C.; James E. Hudson, III

(57) ABSTRACT

A support system for supporting a work surface, such as a floating roof during maintenance of the associated tank. More particularly, the present disclosure is directed to providing a system composed on elements which can be transported without constrictive spaces, assembled within work area, and employed to provide support to a structure above and to provide a safe working environment therein. The support system includes four support members, each having a jack, a lower, and a cap, eight connectors which fix the support members in relation to one another and provide rigidity, and may include two connecting shafts to permit simultaneous adjustment of two jacks on a side of the support system.

11 Claims, 6 Drawing Sheets

(56) References Cited

U.S. PATENT DOCUMENTS

| | | | | |
|---|---|---|---|---|
| 4,441,838 | A | 4/1984 | Cossart | |
| 4,491,452 | A * | 1/1985 | Matovich | B60B 29/002 414/427 |
| 4,630,550 | A | 12/1986 | Weitzman | |
| 5,022,490 | A | 6/1991 | Wyse | |
| 5,230,197 | A | 7/1993 | Hart | |
| 5,367,852 | A * | 11/1994 | Masuda | E04G 11/48 403/174 |
| 5,430,989 | A | 7/1995 | Jones | |
| 5,533,640 | A | 7/1996 | Jolly | |
| 5,575,591 | A | 11/1996 | Vanderklaauw | |
| 5,588,500 | A * | 12/1996 | Yonahara | E04G 1/22 182/115 |
| 5,611,187 | A | 3/1997 | Jones | |
| 5,716,186 | A * | 2/1998 | Jensen | B60B 33/0063 187/244 |
| 5,819,872 | A | 10/1998 | Krause | |
| 6,321,503 | B1 | 11/2001 | Warren | |
| 6,361,252 | B1 | 3/2002 | Leitheiser | |
| 6,520,460 | B2 | 2/2003 | Hallberg et al. | |
| 6,808,338 | B2 | 10/2004 | Zingerman | |
| 7,037,030 | B2 | 5/2006 | McLemore | |
| 7,334,968 | B2 | 2/2008 | Stankus et al. | |
| 8,662,252 | B2 * | 3/2014 | Ogden | E04G 1/02 182/115 |
| 8,671,644 | B2 | 3/2014 | Huang | |
| 9,435,128 | B2 * | 9/2016 | Kreller | E04G 7/02 |
| 10,112,770 | B2 | 10/2018 | Bush | |
| 2010/0018804 | A1 | 1/2010 | Kettunen | |
| 2012/0180283 | A1 | 7/2012 | Erdmann et al. | |
| 2013/0233646 | A1 * | 9/2013 | Boysaw | E04G 1/24 182/115 |
| 2016/0137405 | A1 | 5/2016 | Bush | |
| 2017/0355519 | A1 | 12/2017 | Bush | |

FOREIGN PATENT DOCUMENTS

| | | | |
|---|---|---|---|
| KR | 101415232 | B1 | 7/2014 |
| WO | 2011108990 | A1 | 9/2011 |
| WO | 20120067694 | A1 | 1/2012 |
| WO | 2354374 | B1 | 3/2016 |

* cited by examiner

SUPPORT SYSTEM FOR USE IN CONSTRUCTION

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to systems for supporting a work surface, such as a floating roof during maintenance of the associated tank. More particularly, the present disclosure is directed to providing a system composed on elements which can be transported without constrictive spaces, assembled within work area, and employed to provide support to a structure above and to provide a safe working environment therein.

Description of the Related Art

Working below structures can pose danger. Is it therefore beneficial to provide a system for supporting a work surface while operations are being conducted, whether to support a a floating roof, or pipe, or other structures were in-fill from adjacent soil is not at issue. For example, internal floating roof tanks are well known and use an inner floating roof to prevent tank volatilization of the chemical liquid stored therein. But, like all storage containers, from routine and emergency maintenance is recognized a potential needs. In such situations, vertical support is needed to maintain the floating roof in a position to facilitate such maintenance. However, these tanks lack large access doors or access through the tank shell to permit used of large equipment. Therefore, various cribbing systems have been developed over time to provide the support to the floating roof while being composed of such components that the cribbing system can transported into the storage tank.

External floating roof tanks are well-known and are commonly used to store large quantities of petroleum products such as crude oil or condensate. The tank includes an open-topped cylindrical steel shell and a roof which floats on the top surface of the liquid, and thus maintains position relative to the top surface of the stored liquid and reduces fire risk. The floating roof reduces the potential for a vapor space and thereby loss of the stored liquid.

But maintenance is essential. The American Petroleum Institute ("API") has developed API Standard Tank Inspection Protocol 653 (API 653) as the standard for tanks over 50 feet tall or having a diameter greater than 30 feet, and which covers the maintenance, inspection, alteration and repair of steel, field erected above-ground storage tanks (ASTs) built to API 650 or API 12C standards. Internal inspections under API 653 are required every ten (10) years. Internal inspection assesses the internal and external condition of the above-ground tank and determine its suitability for continued use. However, when the roof-supporting fluid is removed, the roof must still be maintained in a position above the tank floor so personnel may access, inspect, repair, or clean the tank. The system used to provide the roof support must be of components sufficiently narrow that each can pass through door or alternate access before assembly of the components into the system sufficient to provide support to the floating roof and space for working within the tank.

Prior art systems for providing a working area below a surface were not internally adjustable in height without increasing the load on the system during assembly, frustrating the construction of the "cribbing" system. Such systems included stacks of short wood braces, essentially constructing a log cabin structure from the bottom up, which required driving the last section between the floating roof and the prior sections. Alternatively, systems included interlocked components which required the persons assembling the system to forcible reposition the upper sections, under load from the roof, to a suitable height. Other systems provide a frame with a removable pin and various height positions where the height may be adjusted before tying in diagonal cross members, either by moving the components and pinning in place directly under the floating roof or by laying the upright down to disassemble and reassemble the parts for a different height before rotating the upright back into position and then tying-in the connecting and cross-members.

None of these systems contemplate reducing the height of the support system and rolling the support system to a different location. Once in position to support the floating roof, repositioning requires disassembly and forcible relocation.

It would therefore be an improvement to provide a support system which is comprised of components which is readily transported into a work area through even a restrictive space, is adjustable in height in real time without extensive effort or disassembly/reassembly, is adjustable in height at one end without separately engaging multiple jacks, which is stable, and can be readily repositioned.

SUMMARY

The present disclosure therefore meets the above needs and overcomes one or more deficiencies in the prior art. The disclosure provides a support system which includes four support members, each support member having a jack, a lower attachment plate at a support member lower section, and an upper attachment plate at a support member upper section, and a cap, where the jack has a foot at a jack lower end and a crank shaft penetrating through a jack first side and a crank shaft coupling attachment accessible from a jack second side opposite the jack first side, and the cap is coupled to the support member at a support member top, and has eight connectors and two connecting shafts, each connecting shaft sized to couple to the crank shaft coupling attachment. Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides a support system, and which may be used during maintenance of a floating roof tank or to support a piping overhead, or otherwise to provide a supported work space below where in-fill from adjacent soil is not an issue. As can be appreciated, other functional materials may be applied to or included within the components of the disclosure.

Figure 1:
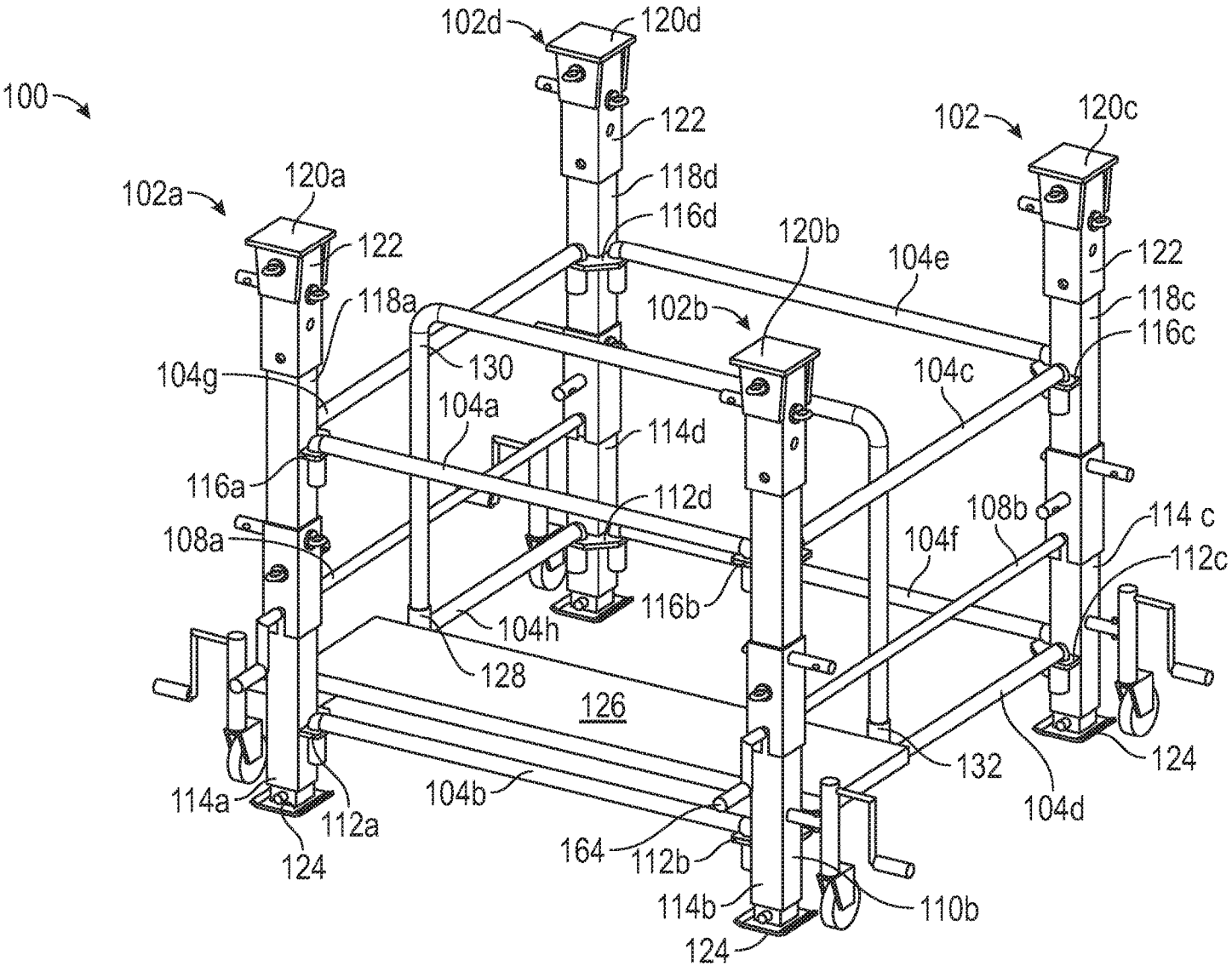
FIG. 1 illustrates an isometric view of the support system according to the present disclosure.

Referring to FIG. 1, an isometric view of the support system 100 according to the present disclosure is provided. The support system 100 includes four support members 102*a*, 102*b*, 102*c*, 102*d*, with each support member 102*a*, 102*b*, 102*c*, 102*d* having a jack 110*a*, 110*b*, 110*c*, 110*d*, a lower attachment plate 112*a*, 112*b*, 112*c*, 112*d* at a support member lower section 114*a*, 114*b*, 114*c*, 114*d*, and an upper attachment plate 116*a*, 116*b*, 116*c*, 116*d* at a support member upper section 118*a*, 118*b*, 118*c*, 118*d*, a cap 120*a*, 120*b*, 120*c*, 120*d*, eight connectors 104*a*, 104*b*, 104*c*, 104*d*, 104*e*, 104*f*, 104*g*, 104*h*, and two connecting shafts 108*a*, 108*b*. The support members 102, eight connectors 104, and two connecting shafts 108 are detachably attachable and provided separately. These components can be readily moved into the work area through an opening, such as the doorway of a floating roof tank shell, and then assembled to provide the support system 100. Beneficially, assembly of the support system 100 does not require specialized tools, or even any tools, as each piece is constructed to engage with another and, upon assembly, provide the support system 100.

Assembly of the support system 100 is straightforward. A first supporting member 102*a* is connected to a second supporting member 102*b* by a first connector 104*a* engaging the first support member upper attachment plate 116*a* and the second support member upper attachment place 116*b* and a second connector 104*b* engaging the first support member lower attachment plate 114*a* and the second support member lower attachment plate 114*b*, tying the first support member 102*a* and the second support member 102*b* together.

Likewise, a third supporting member 102*c* is connected to the second supporting member 102*b* by a third connector 104*c* engaging the second support member upper attachment plate 116*b* and the third support member upper attachment plate 116*c* and a fourth connector 104*d* engaging the second support member lower attachment plate 114*b* and the third support lower attachment plate 114*c*. The first support member 102*a*, second support member 102*b*, and the third support member 102*c* may connected in place or connected on the ground before rotation into an upright position. If positioned vertically during assembly, the third support member 102*c* is positioned out of alignment with the first support member 102*a* and second support member 102*b*, thus providing a three-point stand with an angle between the first support member 102*a* and the second support member 102*b*. If assembled on the ground then rotated up, the third support member 102*c* rotated around to provide an assembly in two planes. Finally, a fourth supporting member 102*d* is connected to the third support member 102*c* and first support member 102*a* by a fifth connector 104*e* and a sixth connector 104*f* engaging the third support member upper attachment plate 116*c* and the first support member attachment plate 116*a*, and a seventh connector 104*g* and the eighth connectors 104*h* engaging the third support member lower attachment plate 114*c* and first support member lower attachment plate 114*a*, respectively. Once all four support members 102 are joined, the support system 100 provides a stable rectangular prism which provides four points of contact to the floating roof and a protected work environment between the support members 102. To contact the floating roof and protect the support members 102, each of the support members has a cap 120*a*, 120*b*, 120*c* and 120*d* coupled to a support member 102 at its support member top 122. The cap 120 may be pivotably coupled to the support member 102 to flex in one plane to better mate to the shape of the floating roof at the point of contact.

The support system 100 may further include a scaffold board 126 and a handrail 130, where the handrail 130 is adapted to be affixed by a coupler 128 to a first connector of the eight connectors 104 associated with the lower attachment plate 112 and by a second coupler 132 to an opposing second connector of the eight connectors 104 the lower attachment plate 112. The scaffold board 126 increases the height at which work can be performed while the handrail 130 provides a point for additional stability and to contain work to the scaffold board 126. When greater height is desired, the handrail 130 may be adapted to be affixed by a coupler 128 to the first connecting shaft 108*a* and by a second coupler 132 to the second connecting shaft 108*b*, and the scaffold board 126 positioned across the first connecting shaft 108*a* and the second connecting shaft 108*b*.

Figure 2:
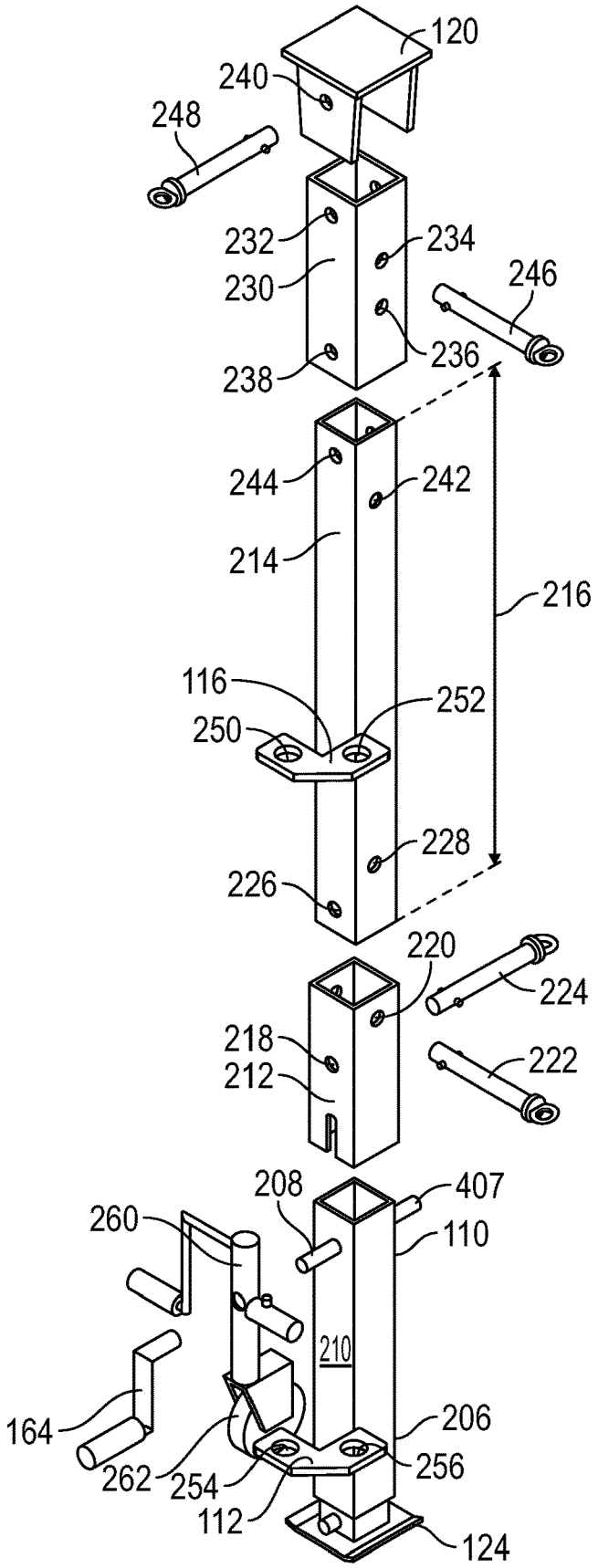
FIG. 2 illustrates an exploded isometric view of a support member of the support system according to the present disclosure.
Figure 3:
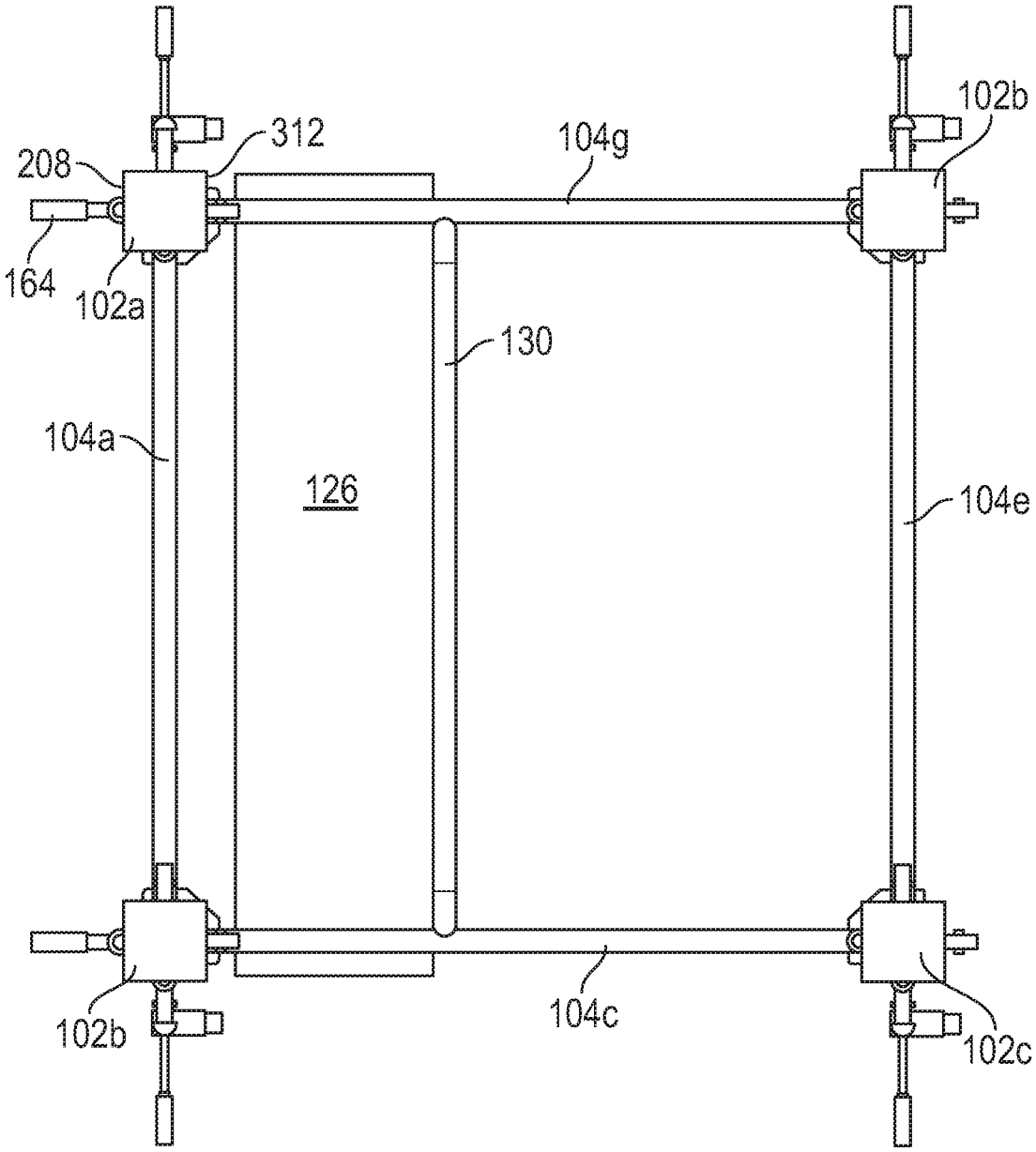
FIG. 3 illustrates a top view of a support system according to the present disclosure.

Referring to FIG. 1 and to FIG. 2, an exploded isometric view of a support member of the support system according to the present disclosure is provided, which illustrates how a jack 110 can engage the floor and how a support member 102 can be adjusted to engage the floating roof. The jack 110 has a foot 124 at a jack lower end 206 and a crank shaft 208 penetrating through a jack first side 210 and a crank shaft coupling attachment 407, illustrated in FIG. 3, accessible from a jack second side 312, illustrated in FIG. 3, opposite the jack first side 210. FIG. 3 provides a top view of a support system 100 according to the present disclosure. When assembled, the support system 100 has a crank shaft coupling attachment 407 accessible from a jack second side 312 opposite the jack first side 210.

Once assembled, the support system 100 is adjusted to the desired height. Height adjustment may be accomplished by use of a jack 110 in each support member. Each jack 110*a*, 110*b*, 110*c*, 110*d*, need not be engaged separately to accomplish this adjustment in the present disclosure. A connecting shaft 108 is sized and adapted to couple to a crank shaft coupling attachment 407 associated with each jack 110 on its jack first side 210 or jack second side 312. A first connecting shaft 108*a* may be coupled to the first support member jack 110*a* at its rear and to the fourth support member jack 110*d* at its front. Thus, the first support member jack 110*a* is engaged, such as by a handle 164 or other driver, at its front and that handle 264 turned, the first connecting shaft 108*a* is likewise rotated and drives the fourth support member jack 110*b*. The first support member 102*a* and the fourth support member 102*d* are thus simultaneously and commonly adjusted. A second connecting shaft 108*b* may be coupled to the second support member jack 110*b* at its rear and to the third support member jack 110*c* at its front so the height of the second support member 102*b* and the third support member 102*e* may be simultaneously and commonly adjusted. The foot 124 provides a point of contact with the ground or floor and may be pivotally attached to the jack 110 to permit adjustment upon contact with any floor not entirely flat and perpendicular to the floating roof.

Figure 6:
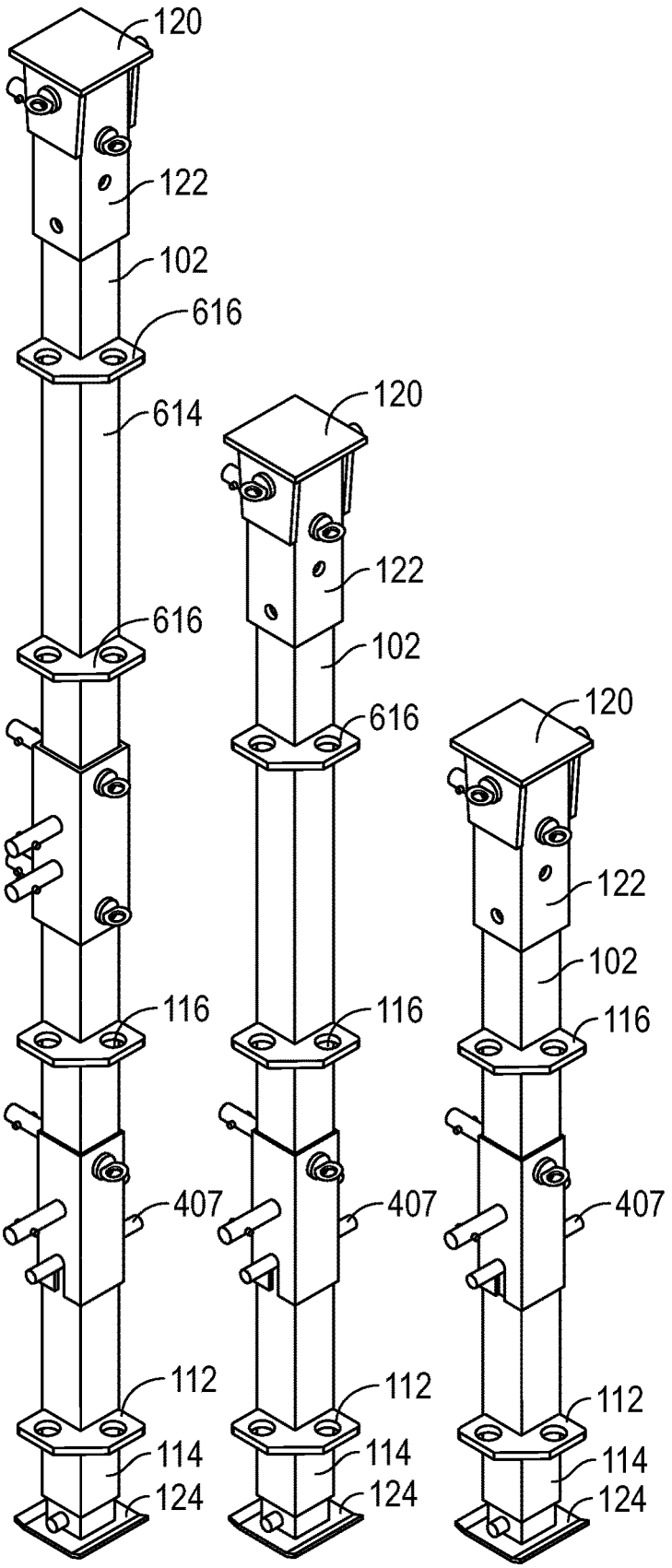
FIG. 6 illustrates the various iterations of the support member of the present disclosure.

Further, as illustrated in FIG. 2 and FIG. 6, when the height adjustment available from the jack 110 is insufficient, each support member 102 may include an extension tube 214 detachably coupleable to the jack 110 where the extension tube 214 has an extension tube height 216. FIG. 6 illustrates the various iterations of the support member of the present disclosure. Various extension tubes 214 may be provided in differing extension tube heights 216 and the appropriate extension tube 214 may be selected to obtain the necessary height for each job. When desired, a secondary extension tube 614, having a length equal or unequal to a length of the extension tube 214, may be used with each support member 102 further increase the height.

Referring to FIG. 2, the support member 102 may have a jack coupled 212 so the jack 110 may be a separate component to further aid in disassembly and transport. Each support member 102 may have a jack coupler 212 sized to couple to the jack 110 without interference to the crank shaft 208 and the crank shaft coupling attachment, where the jack coupler 212 is sized to couple to the extension tube 214. To aid in assembly of the support member 102 and to retain the components in position, the jack coupler 212 may have a jack coupler first passage 218 laterally therethrough and a jack coupler second passage 220 laterally therethrough perpendicular to the jack coupler first passage 218. The extension tube 214 may have an extension tube first passage 226 laterally therethrough and positioned for alignment with the jack coupler first passage 218 and may have an extension tube second passage 220 laterally therethrough perpendicular to the extension tube first passage 226 and positioned for alignment with the jack coupler second passage 220. A bolt, or preferably a jack coupler first toggle pin 222 sized to the jack coupler first passage 218 and the extension tube first passage 226, may be provided to pass through them to retain the two components in relation to one another. Similarly, a second bolt, or a jack coupler second toggle pin 224 sized to the jack coupler second passage 220 and the extension tube second passage 220 may be provided to pass through them to retain the two components in relation to one another. Each of the jack coupler first toggle pin 222 and the jack coupler second toggle pin 224 may be retained in place by spring-loaded pins or by include cotter pin holes and cotter pins. Beneficially, when the jack coupler first toggle pin 222 and the jack coupler second toggle pin 224 are used, no special tools are needed.

Likewise, each support member 102 may have a cap coupler 230 sized to couple to the extension tube 214 and the cap coupler 230 sized to couple to the cap 120. The cap coupler 230 may have a cap coupler first passage 230 laterally therethrough and a cap coupler second passage 234 laterally therethrough perpendicular to the cap coupler first passage 232. The cap 120 may have a cap first passage 240 laterally therethrough and positioned for alignment with the cap coupler first passage 232. The extension tube 214 may have an extension tube third passage 242 laterally therethrough and positioned for alignment with the cap coupler second passage 234 or the cap coupler third passage 236 and an extension tube fourth passage 244 laterally therethrough perpendicular to the extension tube third passage 242 and positioned for alignment with the cap coupler first passage 232. A bolt, or preferably a cap coupler first toggle pin 246 sized to the jack coupler first passage 242 and sized to the cap coupler second passage 234, may be provided to pass through them to retain the two components in relation to one another. Similarly, a second bolt, or preferably a cap coupler second toggle pin 248 sized to the cap coupler first passage 232 and the cap first passage 240, may be provided to pass through them to retain the two components in relation to one another. Likewise, the cap coupler 230 couples to the cap 120. The cap coupler 230 has a cap coupler third passage 236 laterally therethrough perpendicular to the cap coupler first passage 232 and parallel to the cap coupler second passage 234 and positioned on the cap coupler 230 equidistant and opposite a cap coupler mid-plane 258 the cap coupler second passage 234 and has a cap coupler fourth passage 238 laterally therethrough perpendicular to the cap coupler second passage 234 and parallel to the cap coupler first passage 232 and positioned on the cap coupler 230 equidistant and opposite the cap coupler mid-plane 258 the cap coupler first passage 232.

When desired, to aid in repositioning, each support member 102 may a second jack 260 with a wheel 262. The second jack 260 may be engaged to lift the support member 102, the jack 110 and the foot 124 off the ground or floor and then may permit the support system 100 to be repositioned without the need for disassembly or manual lifting. Once in position, the second jack 260 may be reversed to lower the support system 100 to the floor and to lift the wheel 262 of the second jack off the floor.

Figure 4:
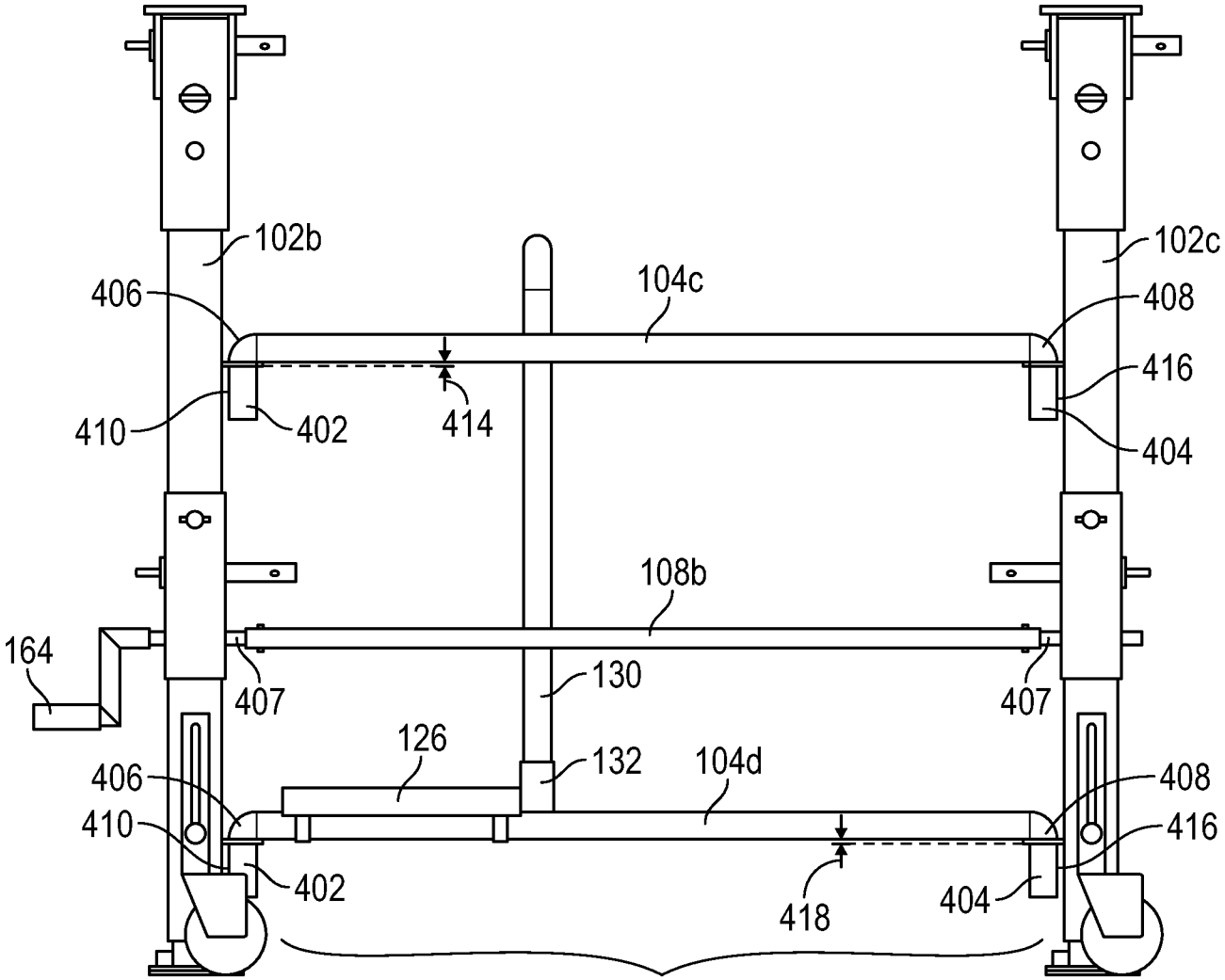
FIG. 4 illustrates a side view of a support system according to the present disclosure.

Referring to FIG. 4, a side view of a support system 100 according to the present disclosure is provided. Each of the connectors 104 terminates with a structure which captures a support member 102 and provides an orthogonal member to provide rigidity and eliminate sway within the support system 100. The support system 100 thus eliminates the need for diagonal members, reducing part count and weight. In the support system 100, each upper attachment plate 116 has an upper attachment plate thickness 414 and includes an upper attachment plate first downward opening 250 immediately adjacent the support member 102 and an upper attachment plate second downward opening 252 immediately adjacent the support member 102, where the upper attachment plate first downward opening 250 and the upper attachment plate second downward opening 252 identically sized. Each connector 104 has a first downward capture member 402 at a connector first end 406 and a second downward capture member 404 at a connector second end 408. The first downward capture member 402 has a first downward capture member outer surface 410 descending downwardly perpendicular to a connector main section 412 between the connector first end 406 and the connector second end 408 at a length at least four times greater than the upper attachment plate thickness 414. The second downward capture member 404 has a second downward capture member outer surface 416 descending downwardly perpendicular the connector main section 412 at a length at least four times greater than the upper attachment plate thickness 414, The first downward capture member outer surface 410 and the second downward capture member outer surface 416 are adapted for contacting the support member 102.

Referring again to FIG. 1 and FIG. 2, the support system 100 may be constructed so the upper attachment plate 116 is affixed to the extension tube 214 and the lower attachment plate 112 is affixed to the jack 110. The lower attachment plate 112 may have a lower attachment plate thickness 418 and may include a lower attachment plate first downward opening 254 immediately adjacent the support member 102 and a lower attachment plate second downward opening 256 immediately adjacent the support member 102, where the lower attachment plate first downward opening 254 and the lower attachment plate second downward opening 256 identically sized. Similarly, the lower attachment plate first downward opening 254 may be sized to match the upper attachment plate first downward opening 250 and the lower attachment plate second downward opening 256 sized to match the upper attachment plate second downward opening 252.

Having parts in vertical alignment can further aid in assembly and disassembly. Therefore, it may desirable to provide the lower attachment plate first downward opening 254 coaxial with to the upper attachment plate first downward opening 250 and the lower attachment plate second downward opening 256 coaxial with to the upper attachment plate second downward opening 252. Coaxial positioning ensures the relative positions of openings on each of the support members 102.

The first support member 102*a* may therefore be connected to the second support member 102*b* by the second connector 104*b* by positioning a first downward capture member 402 into the lower attachment plate first downward opening 254 of the first support member 102*a* and the second downward capture member 404 into the lower attachment plate second downward opening 256 so the first downward capture member outer surface 410 contacts the first support member 102*a* and the second downward capture member outer surface 416 contacts the second downward member 102*b*, providing rigidity and resisting swaying of the parts without a diagonal cross member. The elimination of a diagonal cross member is particularly beneficial as the height of the support member 102 alters the necessary length and attachment point for a diagonal cross member. Referring to FIG. 6, increased rigidity may be accomplished by providing additional extension tubes 614 with further upper attachment plates 616 and increasing the number of connectors 104.

Figure 5:
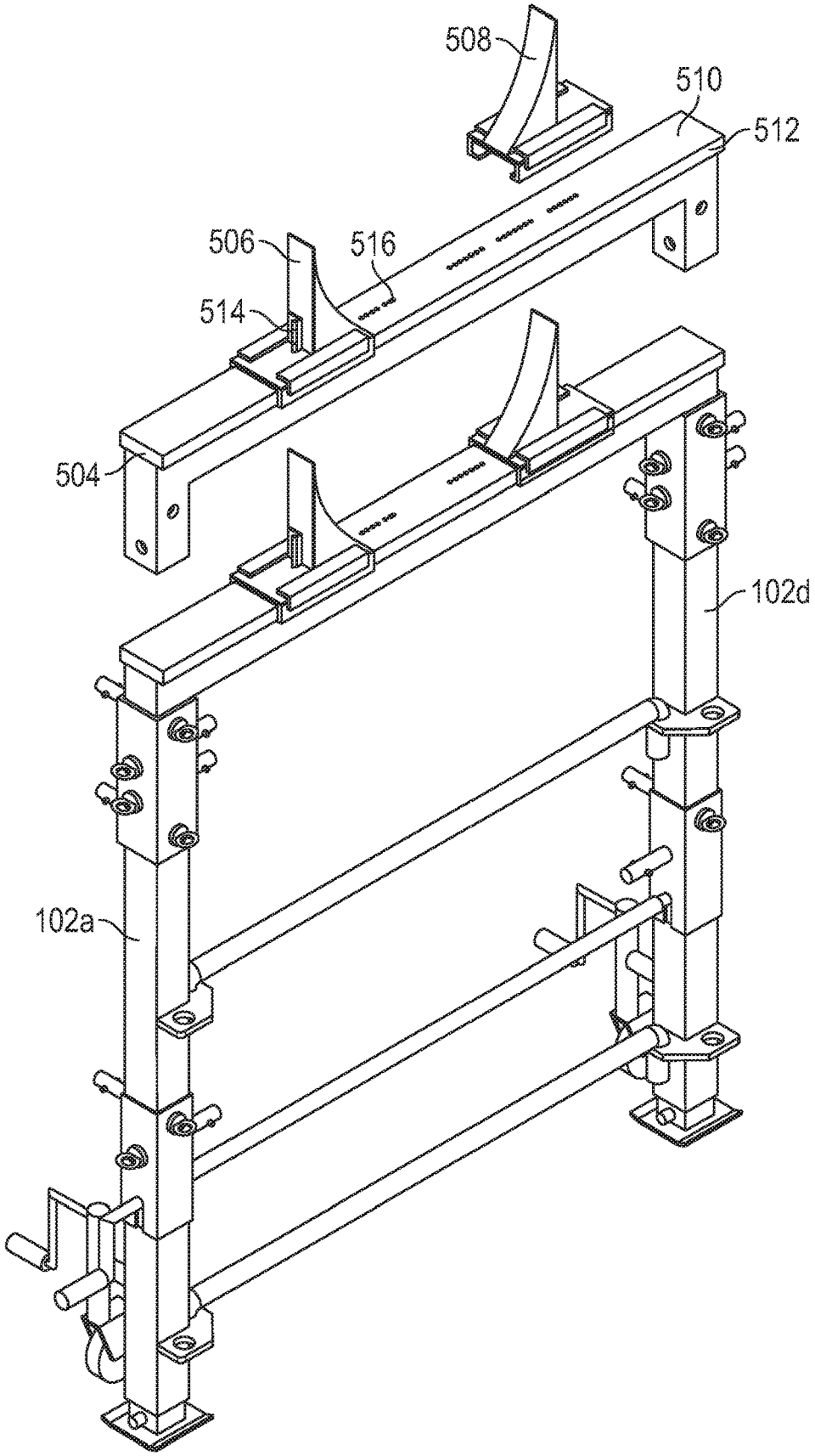
FIG. 5 illustrates a side view of two support members and a cap joining them according to the present disclosure.

Referring to FIG. 5, a side view of two support members 102 and a single cap 502 joining them according to the present disclosure is provided. The support system 100 may be used as pipe cradle for work underneath. When desired, the cap 120 may have a cap center member 502 which spans from a first support member 102 to a second support member 102, functioning as the cap for both while spanning the distance between them. A first pipe cradle member 506 may be provided on the center cap member top 510 and be detachably affixed to the cap 120 and paired with a second pipe cradle member 508 likewise on the center cap member top 510 and detachably affixed to the cap 120. When desired, the first pipe cradle 506 and the second pipe cradle 508 may straddle the cap center member, and may capture the center cap member top 510 when the center cap member top 510 has a shoulder 512. The first pipe cradle member 506 and the second pipe cradle member 508 are slidably coupled to the cap 120 at the resulting cap track 504. Each of the first pipe cradle 506 and the second pipe cradle 508 may thereby be slidably connected to the center cap member top 510 and may be locked in position, such as by a pin 514 in each pipe cradle which may be removably positioned into an opening 516 in the center cap member top 510.

The foregoing disclosure and description is illustrative and explanatory thereof. Various changes in the details of the illustrated construction may be made within the scope of the appended claims without departing from the spirit of the disclosure. The present disclosure should only be limited by the following claims and their legal equivalents.

What is claimed is:

1. A support system for use in construction (100), comprising:

four support members (102), each of the four support members (102) having a jack (110), a lower attachment plate (112) at a support member lower section (114), and an upper attachment plate (116) at a support member upper section (118), and a cap (120);

the jack (110) having a foot (124) at a jack lower end (206) and a crank shaft (208) penetrating through a jack first side (210) and a crank shaft coupling attachment (407) accessible from a jack second side (312) opposite the jack first side (210);

the cap (120) coupled to the support member (102) at a support member top (122);

eight connectors (104);

two connecting shafts (108), each connecting shaft (108) sized to couple to two of the crank shaft coupling attachments (407);

wherein each support member (102) includes an extension tube (214) detachably coupleable to the jack (110);

the extension tube (214) having an extension tube height (216);

the upper attachment plate (116) affixed to the extension tube (214); and the lower attachment plate (112) affixed to the jack (110);

the upper attachment plate (116) having an upper attachment plate thickness (414) and including an upper attachment plate first downward opening (250) immediately adjacent the support member (102) and an upper attachment plate second downward opening (252) immediately adjacent the support member (102), the upper attachment plate first downward opening (250) and the upper attachment plate second downward opening (252) identically sized; and the each of the connectors (104) has a first downward capture member (402) at a connector first end (406) and a second downward capture member (404) at a connector second end (408), the first downward capture member (402) having a first downward capture member outer surface (410) descending downwardly perpendicular to connector main section (412) between the connector first end (406) and the connector second end (408) at a length at least four times greater than the upper attachment plate thickness (414), the first downward capture member outer surface (410) adapted for contacting one of the upper attachment plate (116) and the lower attachment plate (112), and the second downward capture member (404) having a second downward capture member outer surface (416) descending downwardly perpendicular the connector main section (412) at a length at least four times greater than the upper attachment plate thickness (414), the second downward capture member outer surface (416) adapted for contacting the other of the upper attachment plate (116) and the lower attachment plate (112);

the lower attachment plate (112) having a lower attachment plate thickness (418) and including a lower attachment plate first downward opening (254) immediately adjacent the support member (102) and a lower attachment plate second downward opening (256) immediately adjacent the support member (102), the lower attachment plate first downward opening (254) and the lower attachment plate second downward opening (256) identically sized;

the lower attachment plate first downward opening (254) sized to the upper attachment plate first downward opening (250); and the lower attachment plate second downward opening (256) sized to the upper attachment plate second downward opening (252);

the lower attachment plate first downward opening (254) coaxial with to the upper attachment plate first downward opening (250); and the lower attachment plate second downward opening (256) coaxial with to the upper attachment plate second downward opening (252); and wherein each support member (102) has a jack coupler (212) sized to couple to the jack (110) without interference to the crank shaft (208) and the crank shaft coupling attachment (407) and the jack coupler (212) sized to couple to the extension tube (214);

the jack coupler (212) having a jack coupler first passage (218) laterally therethrough;

the jack coupler (212) having a jack coupler second passage (220) laterally therethrough perpendicular to the jack coupler first passage (218);

the extension tube (214) having an extension tube first passage (226) laterally therethrough and positioned for alignment with the jack coupler first passage (218);

the extension tube (214) having an extension tube second passage (220) laterally therethrough perpendicular to the extension tube first passage (226) and positioned for alignment with the jack coupler second passage (220);

a jack coupler first toggle pin (222) sized to the jack coupler first passage (218) and the extension tube first passage (226); and a jack coupler second toggle pin (224) sized to the jack coupler second passage (220) and the extension tube second passage (220).

2. The support system (100) of claim 1, wherein:

each support member (102) has a cap coupler (230) sized to couple to the extension tube (214) and the cap coupler (230) sized to couple to the cap (120);

the cap coupler (230) having a cap coupler first passage (230) laterally therethrough;

the cap coupler (230) having a cap coupler second passage (234) laterally therethrough perpendicular to the cap coupler first passage (232);

the cap (120) having a cap first passage (240) laterally therethrough and positioned for alignment with the cap coupler first passage (232);

the extension tube (214) having an extension tube third passage (242) laterally therethrough and positioned for alignment with the cap coupler second passage (234) or the cap coupler third passage (236);

the extension tube (214) having an extension tube fourth passage (244) laterally therethrough perpendicular to the extension tube third passage (242) and positioned for alignment with the cap coupler first passage (232);

a cap coupler first toggle pin (246) sized to the jack coupler first passage (242) and sized to the cap coupler second passage (234); and a cap coupler second toggle pin (248) sized to the cap coupler first passage (232) and the cap first passage (240).

3. The support system (100) of claim 2, wherein:

the cap coupler (230) having a cap coupler third passage (236) laterally therethrough perpendicular to the cap coupler first passage (232) and parallel to the cap coupler second passage (234) and positioned on the cap coupler (230) equidistant and opposite a cap coupler mid-plane (258) the cap coupler second passage (234); and the cap coupler (230) having a cap coupler fourth passage (238) laterally therethrough perpendicular to the cap coupler second passage (234) and parallel to the cap coupler first passage (232) and positioned on the cap coupler (230) equidistant and opposite the cap coupler mid-plane (258) the cap coupler first passage (232).

4. The support system (100) of claim 3, wherein:

a first of the two connecting shafts (108) is coupled to the crank shaft coupling attachment (407) of a first of the four support members (102) and is coupled to the crank shaft coupling attachment (407) of a second of the four support members (102) so a jack of the first of the four support members (102) is adapted to be engaged identically with a jack of the second of the four support members (102), and a second of the two connecting shafts (108) is coupled to the crank shaft coupling attachment (407) of a third of the four support members (102) and is coupled to the crank shaft coupling attachment (407) of a fourth of the four support members (102) so a jack of the first of the four support members (102) is adapted to be engaged identically with a jack of the second of the four support members (102).

5. The support system (100) of claim 4, further comprising:

four secondary extension tubes, each of a four secondary extension tubes having a secondary extension tube length unequal to a length of the extension tube (214).

6. The support system (100) of claim 5, further comprising:

each support member (102) having a second jack (260), the second jack (260) having a wheel (262).

7. The support system (100) of claim 6, wherein the cap (120) is pivotably coupled to the support member (102).

8. The support system (100) of claim 6, wherein the cap (120) has a cap center member (502), a first pipe cradle member (506) at a center cap member top (510) detachably affixed to the cap (120), and a second pipe cradle member (508) at the cap center member top (510) detachably affixed to the cap (120).

9. The support system (100) of claim 6, wherein the first pipe cradle member (506) at a center cap member top (510) is slidably coupled to the cap (120) at a cap track (504) and wherein the second pipe cradle member (508) at the cap center member top (510) is slidably coupled to the cap (120) at the cap track (504).

10. The support system (100) of claim 7, further comprising a scaffold board (126), and a handrail (130), the handrail (130) adapted to be affixed by a coupler (128) to a first connector of the eight connectors (104) associated with the lower attachment plate (112) and by a second coupler (132) to an opposing second connector of the eight connectors (104) the lower attachment plate (112).

11. The support system (100) of claim 7, further comprising a scaffold board (126), and a handrail (130), the handrail (130) adapted to be affixed by a coupler (128) to a first connecting shaft of the two connecting shafts (108) and by a second coupler (132) to an opposing second connecting shaft of the two connecting shafts (108).

* * * * *